US011097288B2

(12) United States Patent
Wesselmeier

(10) Patent No.: US 11,097,288 B2
(45) Date of Patent: Aug. 24, 2021

(54) FOUNTAIN ATTACHMENT FOR WATER EFFECTS WITH ADJUSTABLE NOZZLE

(71) Applicant: OASE GmbH, Hörstel-Riesenbeck (DE)

(72) Inventor: Reinhard Wesselmeier, Hörstel (DE)

(73) Assignee: OASE GmbH, Hörstel-Riesenbeck (DE)

( * ) Notice: Subject to any disclaimer, the term of this patent is extended or adjusted under 35 U.S.C. 154(b) by 139 days.

(21) Appl. No.: 16/535,090

(22) Filed: Aug. 8, 2019

(65) Prior Publication Data

US 2020/0047193 A1 Feb. 13, 2020

(30) Foreign Application Priority Data

Aug. 9, 2018 (DE) ..... 10 2018 119 424.2

(51) Int. Cl.

| | |
|---|---|
| ***B05B 1/12*** | (2006.01) |
| ***B05B 15/65*** | (2018.01) |
| ***B05B 1/30*** | (2006.01) |
| ***B05B 17/08*** | (2006.01) |

(52) U.S. Cl.

CPC ..... *B05B 1/12* (2013.01); *B05B 1/3073* (2013.01); *B05B 15/65* (2018.02); *B05B 17/08* (2013.01)

(58) Field of Classification Search

CPC .. B05B 1/12; B05B 1/26; B05B 1/262; B05B 1/265; B05B 1/3073; B05B 15/65; B05B 17/08; A62C 31/02; A62C 31/03

See application file for complete search history.

(56) References Cited

U.S. PATENT DOCUMENTS

| | | | | |
|---|---|---|---|---|
| 2,560,278 | A | 8/1947 | Curtis | |
| 2,938,673 | A | 5/1958 | Allenbaugh | |
| 2,991,016 | A * | 7/1961 | Allenbaugh, Jr. | B05B 1/3073 239/458 |
| 3,150,829 | A * | 9/1964 | Specht | B05B 1/12 239/107 |
| 3,387,791 | A | 6/1968 | Allenbaugh, Jr. | |
| 3,784,113 | A | 1/1974 | Specht | |
| 6,007,001 | A * | 12/1999 | Hilton | A62C 31/03 239/452 |
| 6,598,810 | B2 * | 7/2003 | Lanteri | A62C 31/03 239/452 |

(Continued)

FOREIGN PATENT DOCUMENTS

| | | |
|---|---|---|
| AU | 418454 | 3/1968 |
| CN | 207 378 005 | 5/2018 |

(Continued)

*Primary Examiner* — Darren W Gorman

(74) *Attorney, Agent, or Firm* — Gudrun E. Huckett

(57) ABSTRACT

A fountain attachment for water effects has an exterior pipe and an interior pipe disposed inside the exterior pipe. An adjustable nozzle of the fountain attachment has a slot size that can be adjusted by a coaxial displacement of the exterior pipe relative to the interior pipe. At least one guide ball is movably arranged between the exterior pipe and the interior pipe and pretensioned by at least one spring. The guide ball interacts with a guide contour for the coaxial displacement by a rotation of the exterior pipe and the interior pipe relative to each other. A pressure element is arranged between the spring and the guide ball.

14 Claims, 9 Drawing Sheets

(56) References Cited

U.S. PATENT DOCUMENTS

| | | | | |
|---|---|---|---|---|
| 8,006,923 | B2 * | 8/2011 | Stoops | A62C 31/03 239/451 |
| 2003/0127541 | A1 * | 7/2003 | Marino | B05B 1/302 239/539 |
| 2005/0242206 | A1 * | 11/2005 | Saner | B05B 3/04 239/296 |
| 2016/0082448 | A1 * | 3/2016 | Wesselmeier | B05B 17/085 239/424 |

FOREIGN PATENT DOCUMENTS

| | | |
|---|---|---|
| DE | 89 09 482.4 | 12/1989 |
| JP | S5892473 | 6/1983 |
| JP | H0710397 | 2/1990 |

* cited by examiner

Fig. 3
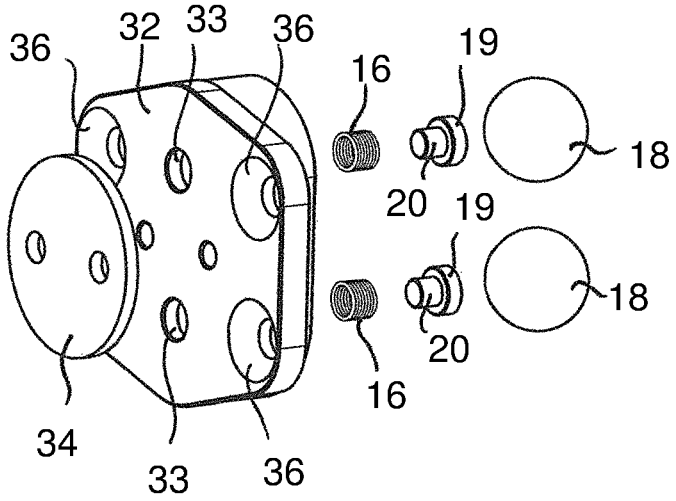
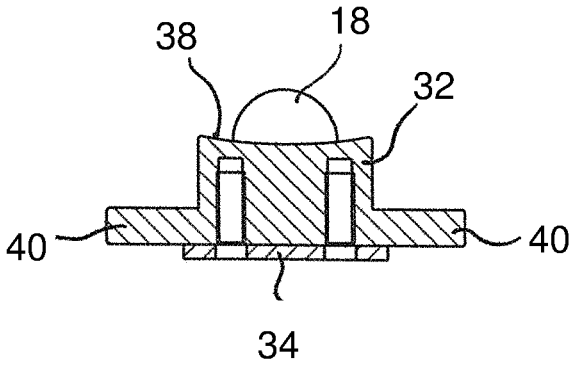
Fig. 4

FOUNTAIN ATTACHMENT FOR WATER EFFECTS WITH ADJUSTABLE NOZZLE

BACKGROUND OF THE INVENTION

The invention relates to a fountain attachment for water effects with an adjustable nozzle comprising a slot size that is adjusted by a coaxial displacement of an exterior pipe relative to an interior pipe. Such a nozzle, for example, can be constructively realized by a deflector element attached to the interior pipe that can be moved in and out of the exterior pipe by the coaxial displacement of the pipes relative to each other.

In such fountain attachments, for adjusting the slot size, a rotation of the pipes relative to each other is translated into the coaxial displacement by means of a guide contour interacting with movable guide balls that are pretensioned by springs. For example, by a rotational movement applied to the exterior pipe, a variable water effect of the fountain attachment can be generated.

In the embodiments known in the prior art, the guide ball is pushed immediately by a spring into the guide contour. The guide ball therefore rubs directly on the spring so that the latter is subjected to strong torsional forces. Both elements wear therefore quickly and must be exchanged in a complex manner. Also, higher water pressures cannot be realized with such a construction.

Therefore, it is the object of the invention to provide an improved fountain attachment that exhibits reduced wear and is suitable in particular for higher water pressures.

SUMMARY OF THE INVENTION

In accordance with the invention, this is achieved by a fountain attachment comprising a pressure element that is arranged between the spring and the guide ball. In this context, between spring and guide ball a pressure element is arranged and a direct friction of the guide ball on the spring is eliminated so that the spring is no longer subjected to strong torsional forces. Also, the guide ball can glide better on the pressure element. In this configuration, the spring as well as the guide ball are subjected to significantly reduced wear.

Preferably, an adjustment in the nozzle is realized by a rotational movement applied to the exterior pipe, for example, by means of a toothed belt because in this case the water-conducting interior pipe is stationary and no complex sealing action and no rotary support are required. The guide contour is advantageously configured so as to extend circumferentially because a rotational movement with a constant rotational speed can be applied for control of the nozzle. The application of the rotational movement can be realized by all drive and gear concepts which are conventional in particular in pond construction and technology.

Preferably, between the guide ball and the guide contour clearance is provided so that water for lubrication and cooling can penetrate into the intermediate spaces.

Even though guide elements in the form of balls are preferred for interaction with the guide contour, it is however in principle also possible to employ guide elements that are not spherical or are not exactly spherical, such as rounded rollers or ellipsoids.

According to a preferred embodiment of the invention, the spring which is in particular embodied as a spiral spring comprises an opening which is engaged by a projection of the pressure element. The in particular central opening of the spring thus accommodates a part of the pressure element so that the latter is guided better. In addition, the spring is stabilized by the pressure element. Accordingly, an unfavorable deformation of the spring as well as an unfavorable movement of the pressure element are counteracted; this further minimizes wear. In addition to spiral springs, the use of plate springs or elastic damping elements, for example, in the form of rubber cylinders, is possible.

In a further advantageous embodiment of the invention, the guide ball, at the side facing the spring, is supported by a ball support comprising a partially spherically embodied bearing contour, wherein the bearing contour has a slightly greater radius than the ball. Due to the adaptation of the bearing contour to the exterior contour of the guide ball, the latter can roll on a large surface. This effects a more uniform and therefore slower wear of the guide ball. Preferably, the ball support comprises a completely spherically embodied bearing contour, with the exception of a cutout through which the spring can act in a pretensioning way on the guide ball via the pressure element.

According to a further preferred embodiment, the spring and the pressure element are guided and supported in a housing element. In this way, canting of the elements is counteracted. Also, the housing element is embodied such that it can be removed easily from the fountain attachment. The spring arranged therein as well as the pressure element are therefore easily accessible and exchangeable. Servicing of the fountain attachment is thus possible in a simple way.

In a further preferred embodiment, the ball support is part of the housing element. Thus, in addition to the spring and the pressure element, the guide balls are also easily accessible or exchangeable for servicing by demounting the housing element.

According to a further advantageous embodiment of the invention, the housing element comprises a continuous channel for accommodating the spring; the continuous channel can be closed off by a closure from the exterior. The closure acts in this context as an abutment for the spring. By removal of the closure, the spring can be removed from the housing element and can therefore be exchanged without the housing element having to be demounted.

In a further advantageous embodiment, the housing element comprises a boundary contour which is matched to the exterior radius of the interior pipe. The housing element, which is configured for supporting the spring and the pressure element as well as optionally the guide ball, contributes by its boundary contour, matched complementarily to the exterior radius of the interior pipe, to the supporting action and thus to a calm and guided rotation of the pipes relative to each other.

According to a further advantageous embodiment of the invention, the circumferentially extending guide contour is embodied such that a plurality of coaxial movements up and down can be realized for each rotation. In particular, the guide contour is of a corrugated shape along the circumferential direction. In this way, high-frequency closing cycles with comparatively minimal rotational speed are realizable.

In a further preferred embodiment of the invention, at least two circumferentially extending guide contours are provided. These guide contours extending parallel to each other interact each with at least one movable guide ball pretensioned by at least one spring and increase the stability of the fountain attachment, in particular at higher pressures and/or higher rotational speeds. For simplification of servicing and exact parallel arrangement of the guide ball, the guide balls interacting with their respective guide contour are supported, preferably above each other, in a common housing element.

According to a further preferred embodiment of the invention, at least two, preferably three, particularly preferred four, guide balls interact with a respective circumferentially extending guide contour. A plurality of guide balls on the same guide contour are preferably arranged with constant spacings in circumferential direction relative to each other so that, for example, in case of four balls, one each is positioned at the 3 o'clock, 6 o'clock, 9 o'clock, and 12 o'clock position. The use of a plurality of guide balls on the same guide contour increases the stability of the fountain attachment, in particular when using higher pressures and/or higher rotational speed.

For simplification of mounting and servicing, preferably each guide ball on the same guide contour is provided with its own housing element. When also a plurality of guide contours are provided, the guide balls that are running in different contours are arranged preferably above each other in a common housing element. Mounting and servicing are simplified also in this way.

In a further advantageous embodiment of the invention, the fountain attachment comprises at least one lubrication channel extending from the exterior side to the interior side of the exterior pipe. Water can thus penetrate for lubrication and cooling between exterior pipe and interior pipe. The lubrication channel is in this context preferably arranged such that it is positioned below the water level in use of the fountain.

According to a further preferred embodiment, the lubrication channel opens into an exterior circumferentially extending groove in which a sealing element that is undersized is arranged. The sealing element thus keeps larger dirt particles from penetrating into the lubrication channel while water for lubrication and cooling can still pass the channel. Clogging of the fountain attachment with coarse dirt is thus effectively prevented.

In a further embodiment of the invention, the external pipe has on its interior side a plurality of circumferentially extending grooves for accommodating dirt. Accordingly, primarily smaller dirt particles which are in particular not retained by the sealing element, are collected in the grooves so that the movement of the pipes relative to each other is not disturbed. In certain intervals, the fountain attachment can be disassembled and the dirt can thus be removed from the grooves.

As a whole, the present invention provides a fountain attachment that produces in a wear-reduced way a variable water effect wherein even higher pressures and/or higher rotation speeds can be employed and which, at the same time, can be easily mounted and serviced.

BRIEF DESCRIPTION OF THE DRAWING

Further advantages and details can be taken from the embodiments described in the following.

FIG. 3 shows a detail of the fountain attachment of FIG. 1 in an exploded illustration.

FIG. 4 shows a detail of FIG. 3 in a cross-sectional view in assembled state.

DESCRIPTION OF THE PREFERRED EMBODIMENTS

Figure 1:
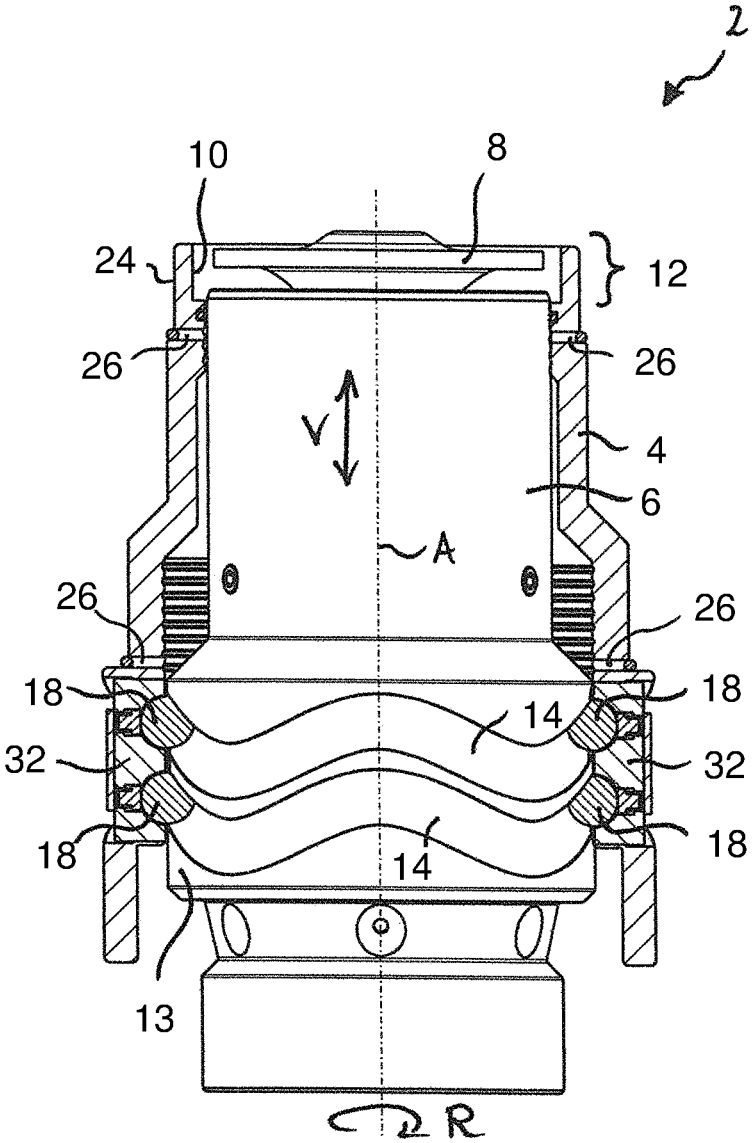
FIG. 1 shows a fountain attachment according to the invention in a partially sectioned illustration.

Same parts or parts that are acting similarly, are provided with identical reference characters, when useful. Individual technical features of the embodiments described in the following can also lead to further inventive embodiments with the features of the afore described embodiments as well as the features of claim 1.

FIG. 1 shows a fountain attachment 2 according to the invention with an exterior pipe 4 and an interior pipe 6 wherein a deflector element 8, in the form of a deflector plate, arranged in the interior pipe 6 and fixedly secured thereto forms together with an interior side 10 of the exterior pipe 4 a nozzle 12 whose slot size can be adjusted by coaxial displacement V of the exterior pipe 4 relative to the interior pipe 6 along a valve axis A. The coaxial displacement V is effected by a rotation R of the pipes 4, 6 relative to each other. For this purpose, the interior pipe 6 is provided on its exterior side 13 with two corrugated circumferentially extending guide contours 14 that extend parallel to each other and interact with guide balls 18 that are pretensioned by springs 16. A rotational movement R applied to the exterior pipe 4 is translated into the coaxial displacement V by the interacting guide balls 18 and guide contours 14.

Figure 2:
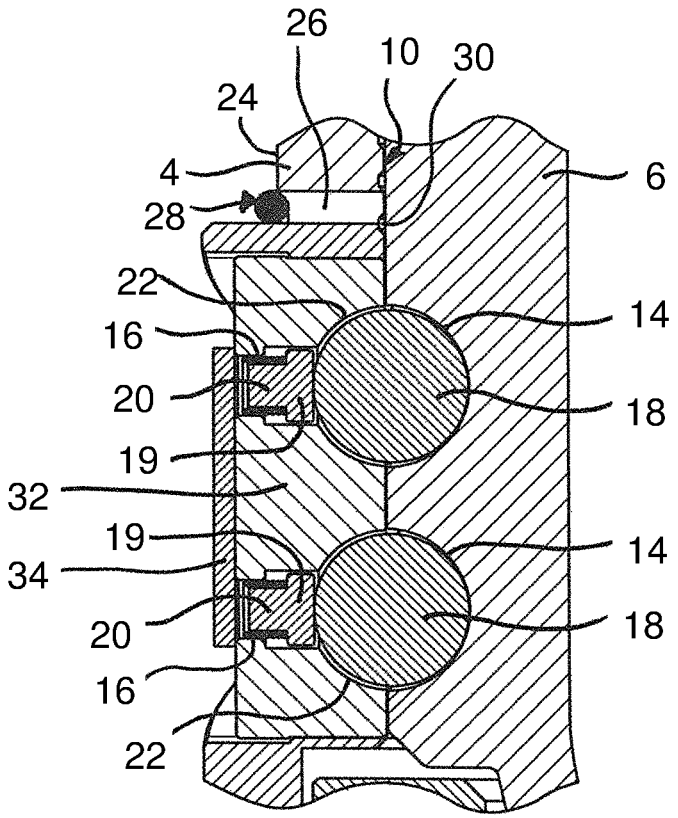
FIG. 2 shows a detail of the fountain attachment of FIG. 1.

FIG. 2 shows the guide balls 18 in a detail view wherein now the interior pipe 6 is illustrated in section view also. Between the springs 16 and the guide balls 18 a pressure element 19 is arranged, respectively, that provides better gliding properties than the spring 16. A projection 20 of the pressure element 19 projects into an opening of the spring 16 whereby the latter is stabilized. At the same time, the pressure element 19 is guided better by the spring 16 surrounding the projection 20. The guide balls 18, at the side facing the springs 16, are each supported by means of a ball support 22 comprising a spherically embodied bearing contour wherein the spring 16 by means of the pressure element 19 can act on the guide balls 18 through a cutout in the ball support 22. The bearing contour comprises in this context a slightly larger radius than the guide ball 18. The guide balls 18 are supported relative to the guide contours 14 as well as relative to the ball support 22 with some clearance so that water for cooling and lubrication can penetrate into the corresponding intermediate spaces.

So that water for lubrication and cooling can penetrate between exterior pipe 4 and interior pipe 6, the fountain attachment 2 is provided with a lubrication channel 26 extending from an exterior side 24 to the interior side 10 of the exterior pipe 4. The lubrication channel 26 opens outwardly into an exterior circumferentially extending groove in which a sealing element 28 that is undersized is arranged so that water can penetrate but coarse dirt particles are retained. At the interior side 10 of the exterior pipe 4, a plurality of circumferentially extending grooves 30 are additionally provided in which smaller dirt particles, which have reached the interior of the fountain attachment 2 past the sealing element 28, can deposit so that the lubrication is not negatively affected.

Spring 16 and pressure element 19 are guided and supported together in a housing element 32. The housing element 32 can be removed and enables simple servicing and in particular the comfortable exchange of springs 16 and pressure elements 19. Moreover, the ball support 22 is partially formed by the housing element 32 so that the ball supports 22 are also accessible by removal of the housing element 32.

The housing element 32 comprises a continuous channel 33 (see FIG. 3) for receiving the springs 16 which is closed off from the exterior by a closure 34. By removing the closure 34, the springs 16 can thus be removed from the housing element 32 without the latter having to be removed.

FIG. 3 shows the housing element 32 with the elements that are at least partially supported therein in an exploded illustration. For attachment of the housing element 32 at the exterior pipe 4, four openings 36 for attachment means are provided. For attaching the closure 34 at the housing element 32, corresponding openings or threads can be provided.

As can be seen in FIG. 4, the housing element 32 comprises moreover a boundary contour 38 which is matched to the exterior radius of the interior pipe 6. Also, the housing element 32 is provided with two flange flanks 40 arranged laterally relative to the ball support 22 (not illustrated) wherein the openings 36 (not illustrated; compare FIG. 3) for attachment means are arranged in this area.

Figure 5:
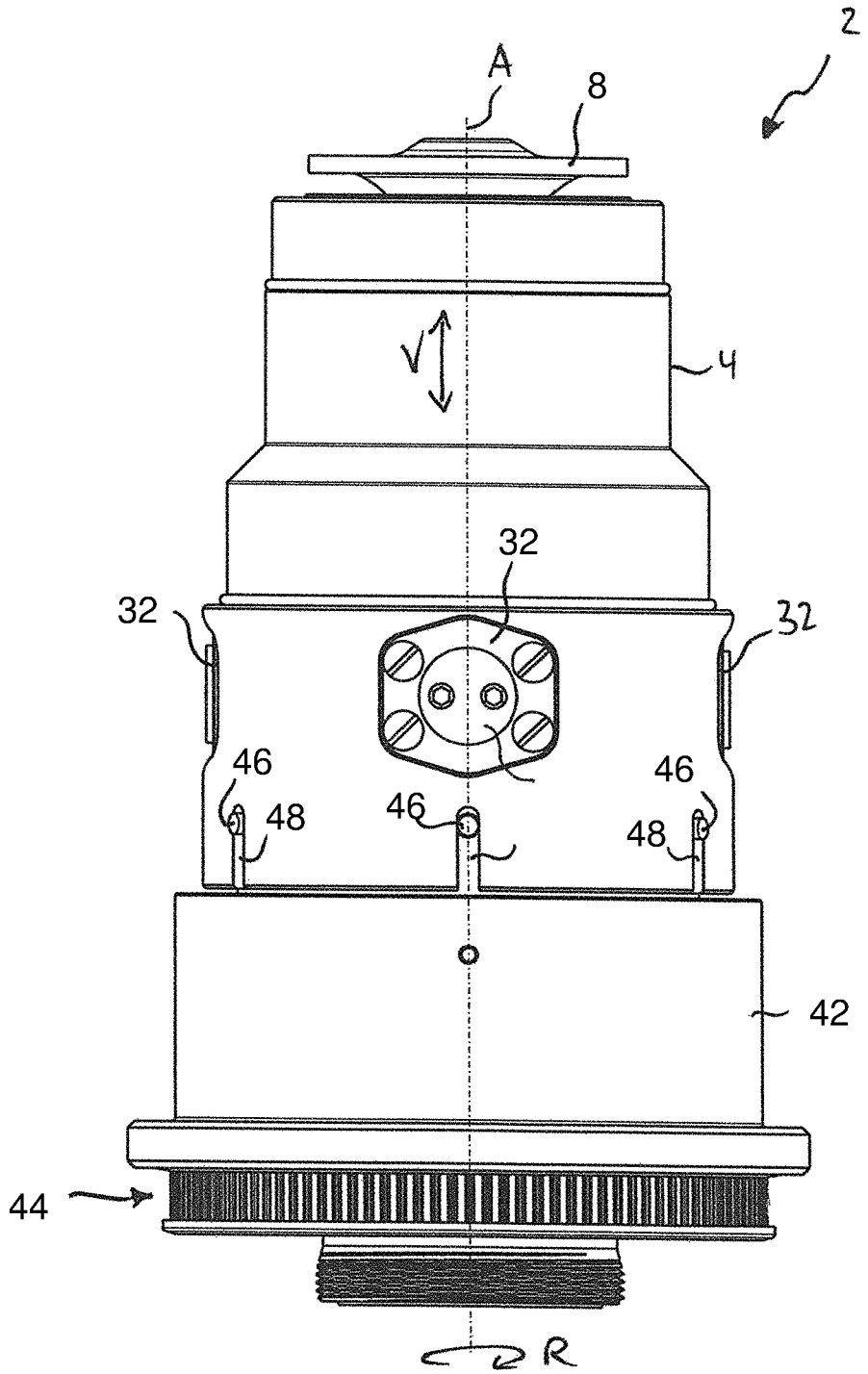
FIG. 5 shows a fountain attachment according to the invention similar to FIG. 1 in a side view.

FIG. 5 shows a fountain attachment 2 according to the invention with a drive segment 42 arranged below the exterior pipe 4 that can be driven by means of a tooth contour 44. A rotational movement R about the valve axis A applied to the drive segment 42 is transmitted by followers 46 to the exterior pipe 4. The guide balls 18 (not illustrated) supported in the housing elements 32 translate the rotational movement R into a coaxial displacement V of the exterior pipe 4 relative to the stationary interior pipe 6 of which only the deflector plate 8 can be seen. Corresponding slots 48 in the region of the followers 46 enable up and down movements of the exterior pipe 4.

Figure 6:
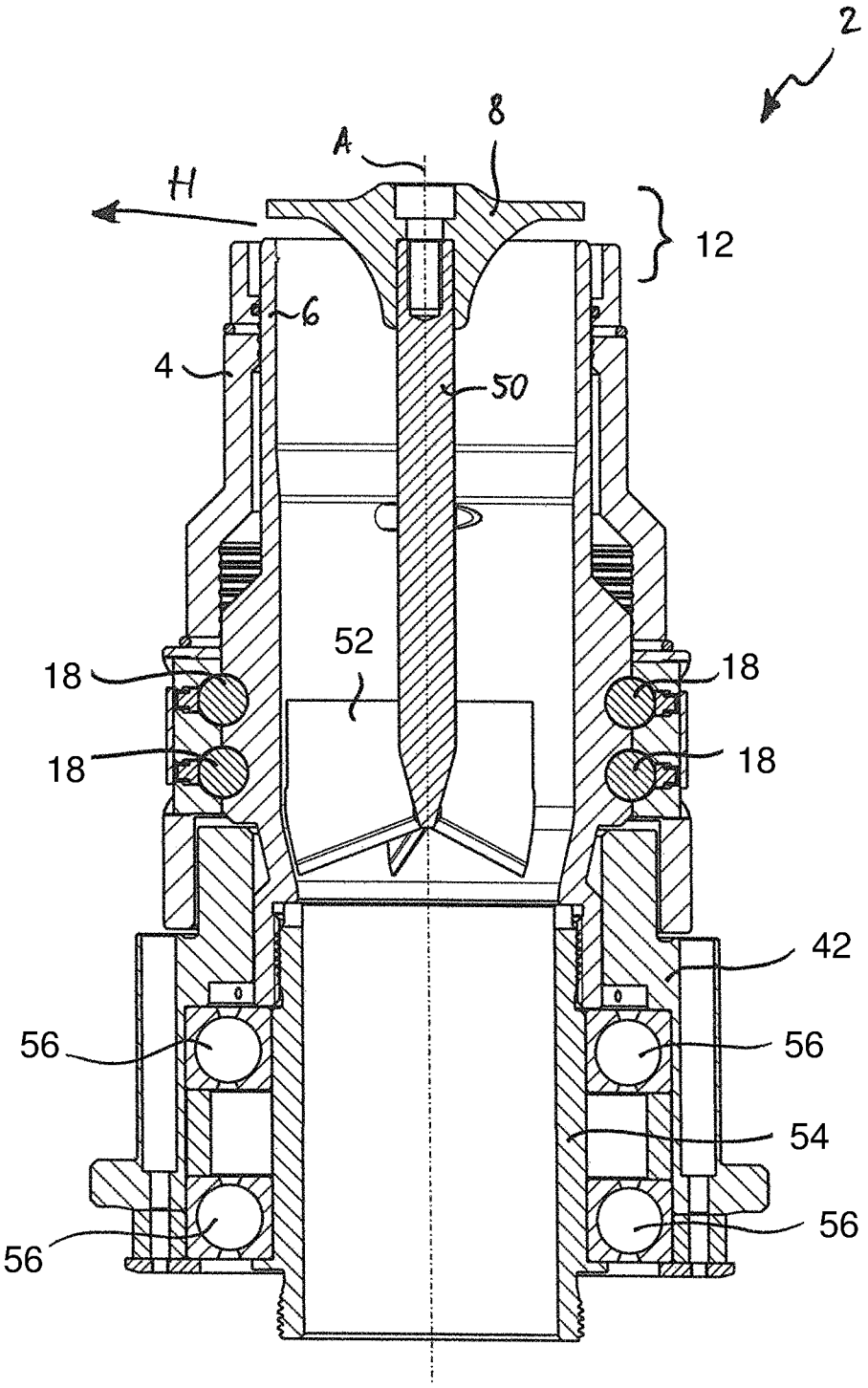
FIG. 6 shows the fountain attachment of FIG. 5 in a sectioned illustration.
Figure 7:
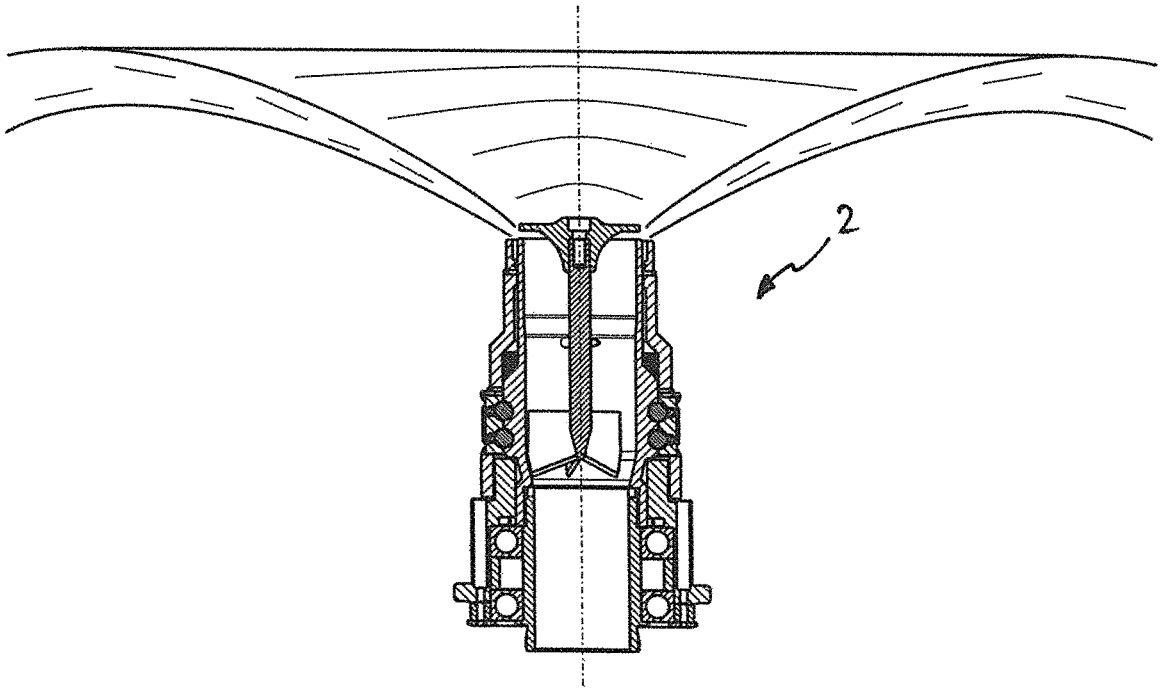
FIG. 7 illustrates a water effect of the fountain attachment of FIG. 6.

FIG. 6 shows the fountain attachment of FIG. 5 in a section illustration. The deflector element 8 is fixedly secured by a shaft 50 to the interior pipe 6. At the bottom end of the shaft 50, a flow rectifier 52 provided with a plurality of vanes is provided. The interior pipe 6 is secured at a water inlet socket 54 by means of a screw thread. The drive module 42 is supported by ball bearings 56 relative to the inlet socket 54 so as to be rotatable about the valve axis A. The deflector element 8 and the interior side 10 of the exterior pipe 4 form the nozzle 12. The guide balls 18 are located relative to the guide contour 14 at the lowermost position so that the exterior pipe 4 in axial direction is farthest removed from the deflector element 8 and the water escapes in a rather horizontal direction H from the nozzle 12. The corresponding water effect is illustrated in FIG. 7.

Figure 8:
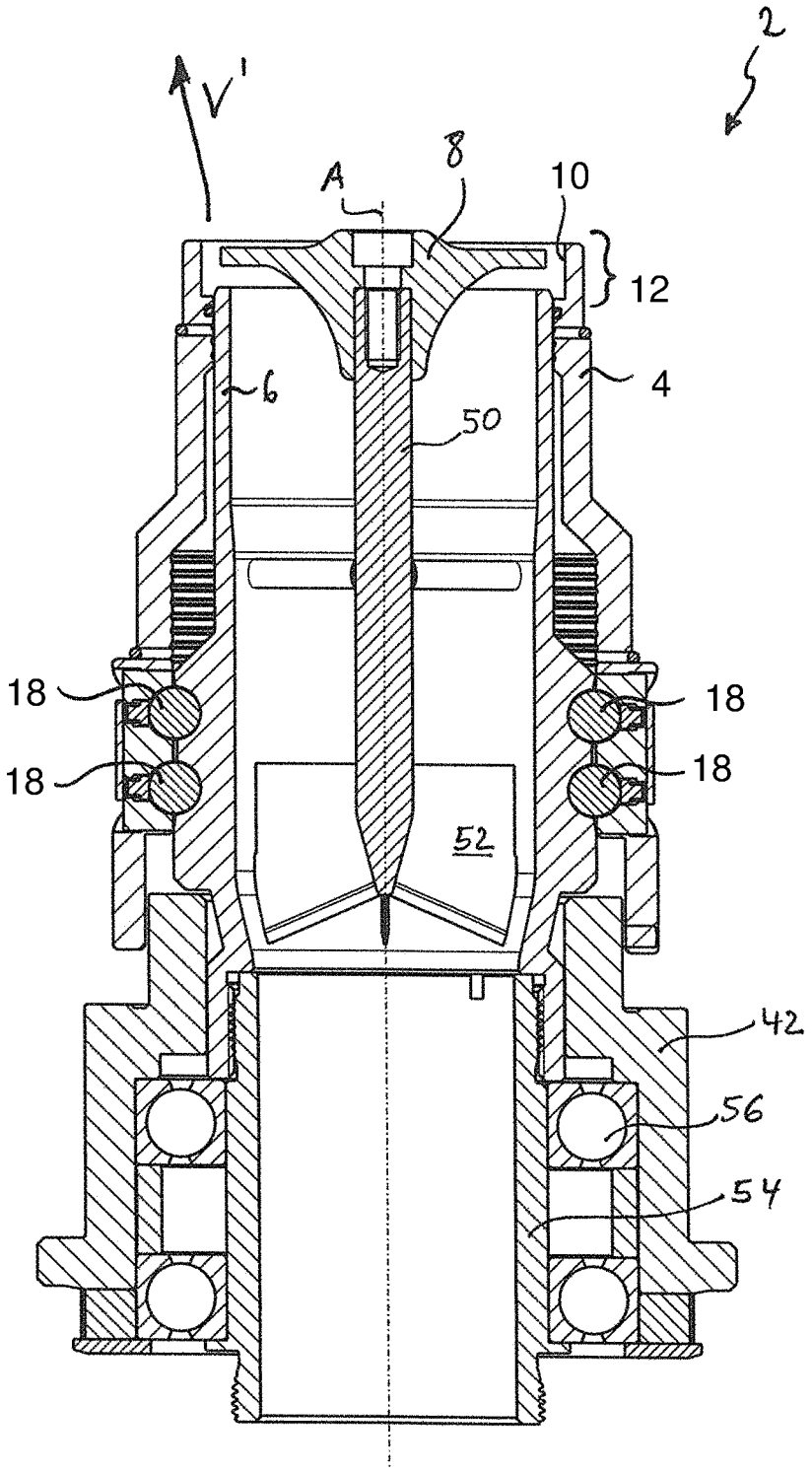
FIG. 8 shows the fountain attachment of FIG. 5 with exterior pipe moved upwardly.
Figure 9:
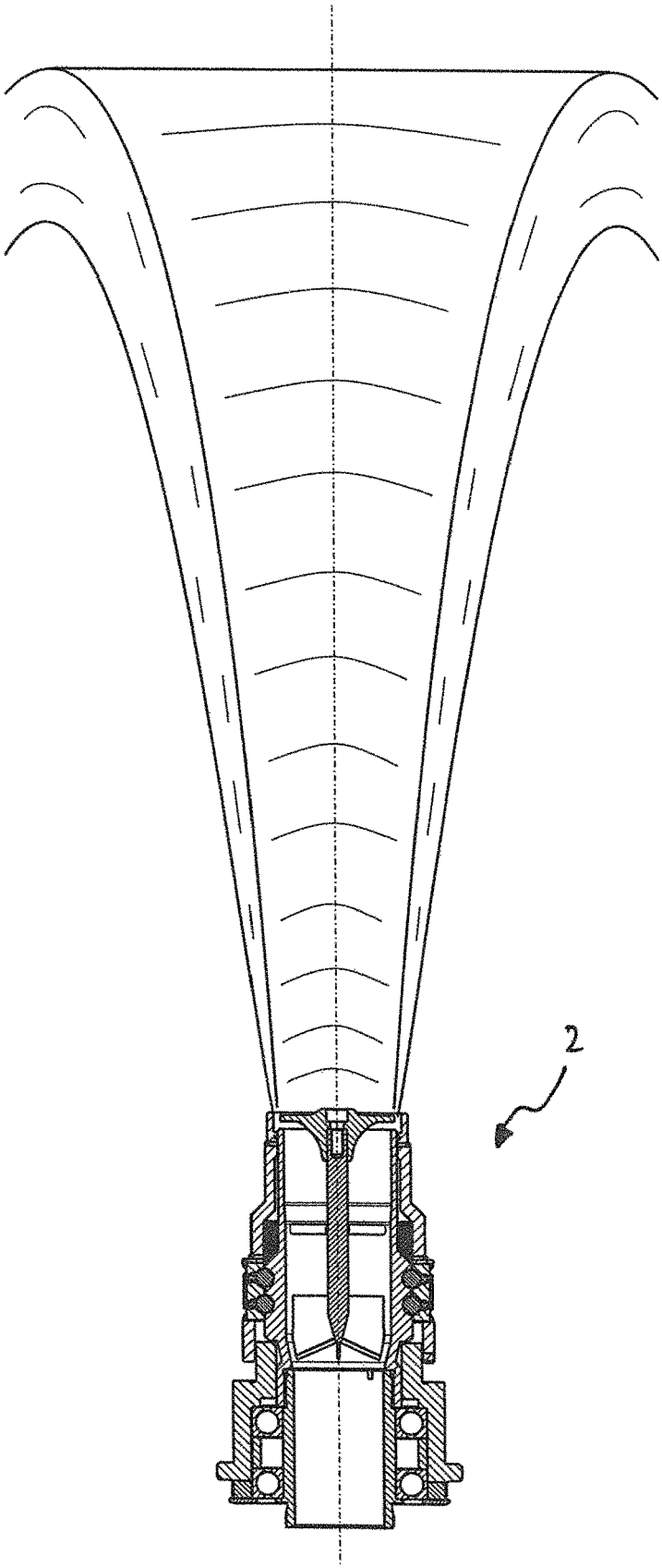
FIG. 9 shows the water effect of the fountain attachment of FIG. 8.

In contrast thereto, in FIG. 8, the exterior pipe 4 is positioned at its highest possible position wherein the interior side 10 of the exterior pipe 4 laterally bounds the deflector element so that water escapes in a substantially vertically extending direction V' from the nozzle 12. The corresponding water effect is illustrated in FIG. 9.

Figure 10:
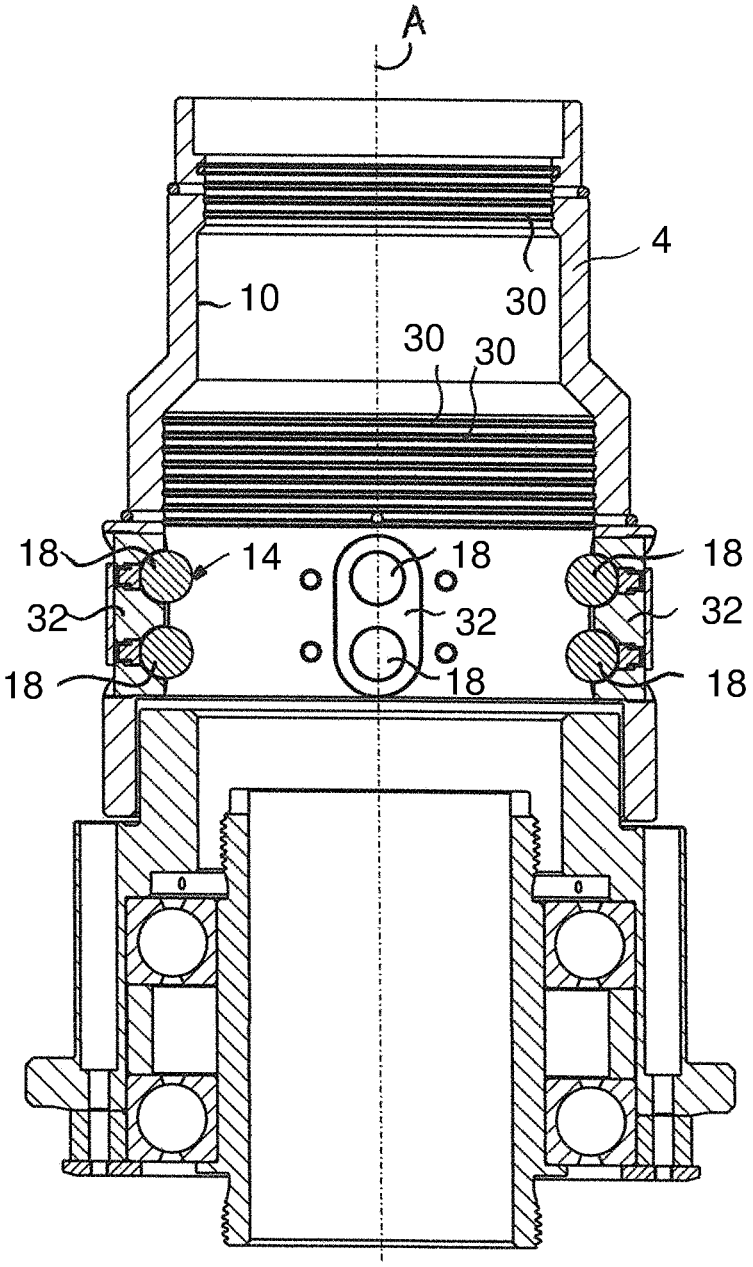
FIG. 10 is a section illustration according FIG. 6 with interior pipe removed.

FIG. 10 shows the fountain attachment of FIG. 6 with removed interior pipe 6. It can be seen that relative to the valve axis A in circumferential direction four housing elements 32 with two guide balls 18 each are provided that each interact with a respective guide contour 14. The exterior pipe 4 comprises also at its interior side 10 a plurality of circumferentially extending grooves 30 for accommodating dirt.

The specification incorporates by reference the entire disclosure of German priority document 10 2018 119 424.2 having a filing date of Aug. 9, 2018.

While specific embodiments of the invention have been shown and described in detail to illustrate the inventive principles, it will be understood that the invention may be embodied otherwise without departing from such principles.

What is claimed is:

1. A fountain attachment for water effects, the fountain attachment comprising:

an exterior pipe and an interior pipe disposed inside the exterior pipe;

an adjustable nozzle, wherein the adjustable nozzle comprises a slot size configured to be adjusted by a coaxial displacement of the exterior pipe relative to the interior pipe;

at least one guide ball, movably arranged between the exterior pipe and the interior pipe and pretensioned by at least one spring, interacting with a guide contour for the coaxial displacement by a rotation of the exterior pipe and the interior pipe relative to each other;

a pressure element arranged between the at least one spring and the at least one guide ball.

2. The fountain attachment according to claim 1, wherein the at least one spring comprises an opening and the pressure element comprises a projection engaging the opening of the at least one spring.

3. The fountain attachment according to claim 2, wherein the at least one spring is a spiral spring.

4. The fountain attachment according to claim 1, wherein the at least one guide ball, at a side facing the at least one spring, is supported in a ball support that comprises, at least in sections thereof, a spherically embodied bearing contour, wherein the bearing contour has a radius that is slightly greater than a radius of the guide ball.

5. The fountain attachment according to claim 4, further comprising a housing element, wherein the at least one spring and the pressure element are supported and guided in the housing element.

6. The fountain attachment according to claim 5, wherein the ball support is a part of the housing element.

7. The fountain attachment according to claim 5, wherein the housing element comprises a continuous channel and a closure configured to close the continuous channel from an exterior side of the housing element, wherein the at least one spring is accommodated in the continuous channel.

8. The fountain attachment according to claim 5, wherein the housing element comprises a boundary contour matched to an exterior radius of the interior pipe.

9. The fountain attachment according to claim 1, wherein the guide contour extends circumferentially and is embodied such that a plurality of said coaxial displacement upward and downward are realized for each complete rotation of the exterior pipe and the interior pipe relative to each other.

10. The fountain attachment according to claim 1, wherein at least two of said guide contour are provided and said at least two guide contours extend circumferentially.

11. The fountain attachment according to claim 1, wherein at least two of said at least one guide ball are interacting with the guide contour.

12. The fountain attachment according to claim 1, comprising at least one lubrication channel extending from an exterior side to an interior side of the exterior pipe.

13. The fountain attachment according to claim 12, wherein the lubrication channel opens into an exterior circumferentially extending groove provided with a sealing element, wherein the sealing element is undersized in relation to a width of the groove to allow water to penetrate into the groove but prevent dust particles from penetrating into the groove.

14. The fountain attachment according to claim 1, wherein the exterior pipe comprises an interior side comprising a plurality of circumferentially extending grooves for accommodating dirt.

* * * * *